United States Patent [19]

Iwasaki et al.

[11] Patent Number: 4,737,484

[45] Date of Patent: Apr. 12, 1988

[54] HEAT-SENSITIVE RECORDING MATERIAL

[75] Inventors: Masayuki Iwasaki; Hiroshi Kamikawa; Toshimasa Usami, all of Shizuoka, Japan

[73] Assignee: Fuji Photo Film Co., Ltd., Kanagawa, Japan

[21] Appl. No.: 725,197

[22] Filed: Apr. 19, 1985

[30] Foreign Application Priority Data

Apr. 20, 1984 [JP] Japan ..... 59-79831
May 4, 1984 [JP] Japan ..... 59-89626

[51] Int. Cl.[4] ..... B41M 5/22

[52] U.S. Cl. ..... 503/209; 427/150; 430/138; 430/151; 430/176; 430/177; 503/215; 503/217

[58] Field of Search ..... 346/200, 209, 216–218, 346/225; 427/150–152; 430/138, 151, 176, 177; 503/200, 209, 215–218, 225

[56] References Cited

U.S. PATENT DOCUMENTS 4,529,681 7/1985 Usami et al. ..... 430/138

FOREIGN PATENT DOCUMENTS 0109838 5/1984 European Pat. Off. ..... 503/215

*Primary Examiner*—Bruce H. Hess
*Attorney, Agent, or Firm*—Sughrue, Mion, Zinn, Macpeak, and Seas

[57] ABSTRACT

A heat-sensitive recording material is described, comprising a support having provided thereon a recording layer comprising a diazo compound and a coupling component, wherein the improvement comprises including said diazo compound and at least one compound selected from a polymerizable compound containing an ethylenically unsaturated bond therein or at least one compound capable of releasing a free radical upon exposure to light together in microcapsules.

10 Claims, No Drawings

HEAT-SENSITIVE RECORDING MATERIAL

FIELD OF THE INVENTION

The present invention relates to heat-sensitive recording materials, and particularly to fixable diazo type heat-sensitive recording materials. More particularly, the present invention relates to heat-sensitive recording materials in which the color hue of the background is white, storability prior to heat-sensitive recording is excellent, color density is high in thermal recording, and photofixation is possible after thermal recording.

BACKGROUND OF THE INVENTION

As recording materials for heat-sensitive recording methods, leuco color formation type heat-sensitive recording materials have been generally employed. However, these heat-sensitive recording materials involve disadvantages, in that undesired color formation can occur in inappropriate portions due to rough handling after recording, due to heating or adherence of solvents thereto, etc., to thereby contaminate recorded images. As heat-sensitive recording materials free from these disadvantages, diazo color formation type heat-sensitive recording materials have been extensively investigated in recent years. These techniques are disclosed, for example, in Japanese Patent Application (OPI) No. 123086/82 (the term "OPI" as used herein refers to a "published unexamined Japanese patent application"), *Journal of the Image Electronics Association,* Vol. 11, p. 290 (1982), etc., in which images are thermally recorded on recording materials comprising diazo compounds, coupling components and basic components (including substances capable of becoming basic when heated) and then exposed to light to thereby decompose the unreacted diazo compounds, resulting in discontinuation of the color formation. According to this method, prevention of color formation (hereafter referred to as fixing) in portions where recording is unnecessary can indeed be achieved. However, even with such recording materials, precoupling sometimes gradually proceeds during storage to cause undesired coloration (fogging). For this reason, any one of color forming components is made present in the form of discontinuous particles (solid dispersion) to prevent contact between the components, whereby the precoupling is prevented. However, such involves disadvantages that storability of recording materials (hereafter referred to as shelf storage) is unsatisfactory and further color formation upon heating is deteriorated. As another countermeasure, it is known that diazo compounds are separated from coupling components into separate layers in order to minimize the contact between the components (described, for example, in Japanese Patent Application (OPI) No. 123086/82, supra). According to this method, shelf storage is improved but reduction in color formation upon heating is serious, so that the system fails to respond to high speed recording having a short pulse width, and is therefore not practical. In addition, as a method for providing satisfactory shelf storage and color formation upon heating simultaneously, it is known that either coupling component or basic substance is encapsulated by non-polar waxy substances (Japanese Patent Application (OPI) Nos. 44141/82 and 142636/82) or by hydrophobic high molecular weight substances (Japanese Patent Application (OPI) No. 192944/82). However, these encapsulation methods comprise dissolving waxes or polymeric substances in solvents thereof and dissolving or dispersing color forming components in these solvents to form capsules, which is different from the concept of conventional capsules which comprise a core substance covered with a shell therearound. For this reason, in the case that the color forming components are dissolved to form such capsules, the color forming components do not constitute the core substances of the capsules, but rather are homogeneously mixed with the encapsulating materials, whereby precoupling gradually proceeds at the interface of the capsule wall during storage so that shelf storage is not sufficiently satisfactory. Furthermore, when the color forming components are dispersed to form capsules, no color formation occurs unless the capsule walls are melted by heating; this results in decreased color formation upon heating. Furthermore, a problem is encountered in production in that solvents used for dissolving the waxes or the polymeric substances should be removed after the capsules were formed, but such cannot be done sufficiently satisfactory.

Therefore, for solving the foregoing problems, a heat-sensitive recording material has been disclosed, made by a method of microencapsulation which comprises incorporating at least one of the components participating in the color forming reaction in a core substance and forming a wall around the core material by polymerization (Japanese Patent Application (OPI) No. 190886/84, corresponding to U.S. Pat. Ser. No. 600,267).

Even in the heat-sensitive recording material according to this microencapsulation method, however, it was impossible to eliminate a disadvantage that the background areas (areas excluding recorded images) are stained to a somewhat yellow color when photofixation follows thermal recording.

SUMMARY OF THE INVENTION

Therefore, a first object of the present invention is to provide heat-sensitive recording materials in which the color hue in the background areas is white, shelf storage is excellent, and color formation upon heating is high.

A second object of the present invention is to provide heat-sensitive recording materials in which the unreacted diazo compounds are photodecomposed after thermal recording to fix them.

A third object of the present invention is to provide heat-sensitive recording materials having excellent adaptability in production.

As a result of extensive investigations, the present inventors have solved the above-described problems by heat-sensitive recording materials comprising a support having provided thereon a recording layer comprising a diazo compound and a coupling component, characterized by including said diazo compound and at least one compound selected from a polymerizable compound containing an ethylenically unsaturated bond wherein or at least one compound capable of releasing a free radical upon exposure to light together in microcapsules.

According to a preferred embodiment, the recording layer also contains a basic substance, or a substance capable of becoming basic when heated.

DETAILED DESCRIPTION OF THE INVENTION

The microcapsules of the present invention are not of the type that have been employed in conventional recording material, in which the microcapsule wall is destroyed upon heating or pressure to bring a reactive substance contained in cores in the microcapsules into contact with a reactive substance outside the microcapsules, but rather are a type undergoing a reaction, upon heating, of reactive substances present in and outside of the cores of the microcapsules, mainly by the permeation of these reactive substances through the microcapsule walls. This reaction whereby colored images are obtained is called a coupling reaction; the diazo compounds which do not take part in the reaction are decomposed by light and converted into compounds having no coupling reactivity. At this stage, the diazo compounds are generally tinted to an undesired yellow color by photodecomposition; however, when the polymerizable compounds are present as in the present invention, the diazo compounds are not tinted by photodecomposition and lost the coupling reactivity. While the mechanism is unclear, polymerization initiators are not necessarily required because the desirable effects are not obtained by polymerizing the polymerizable compounds. Rather, the desirable effects are obtained even though no polymerization initiators are incorporated in an amount that hardening occurs through polymerization.

The polymerizable compound having an ethylenically unsaturated bond therein (hereafter referred to as vinyl monomer) as used in the present invention refers to a compound having at least one ethylenically unsaturated bond (a vinyl group, a vinylidene group, etc.) in the chemical structure thereof and takes a chemical configuration of a monomer, a prepolymer, i.e., a dimer, a trimer and other oligomer and mixtures thereof as well as copolymers thereof, etc. Examples of the polymerizable compounds include unsaturated carboxylic acids and salts thereof, esters of unsaturated carboxylic acids with aliphatic polyvalent alcohol compounds, amides of unsaturated carboxylic acids with aliphatic polyvalent amine compounds, etc.

Specific examples of unsaturated carboxylic acids include acrylic acid, methacrylic acid, itaconic acid, crotonic acid, isocrotonic acid, maleic acid, etc.

As salts of these unsaturated carboxylic acids, sodium salts, potassium salts, etc., are useful.

Specific examples of esters of unsaturated carboxylic acids with aliphatic polyvalent alcohol compounds include acrylic acid esters such as ethylene glycol diacrylate, triethylene glycol triacrylate, 1,3-butanediol diacrylate, tetramethylene glycol diacrylate, propylene glycol diacrylate, trimethylolpropane triacrylate, trimethylolethane triacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, sorbitol triacrylate, sorbitol tetraacrylate, sorbitol pentaacrylate, sorbitol hexaacrylate, polyester acrylate oligomer, etc.; methacrylic acid esters such as tetramethylene glycol dimethacrylate, triethylene glycol dimethacrylate, trimethylolpropane trimethacrylate, trimethylolethane trimethacrylate, ethylene glycol dimethacrylate, 1,3-butanediol dimethacrylate, pentaerythritol dimethacrylate, pentaerythritol trimethacrylate, dipentaerythritol dimethacrylate, sorbitol trimethacrylate, sorbitol tetramethacrylate, bis[p-(3-methacryloxy-2-hydroxypropoxy)phenyl]dimethylmethane, bis[p-(acryloxyethoxy)phenyl]dimethylmethane, etc.; itaconic acid esters such as ethylene glycol diitaconate, propylene glycol diitaconate, 1,3-butanediol diitaconate, 1,4-butanediol diitaconate, tetramethylene glycol diitaconate, pentaerythritol diitaconate, sorbitol tetraitaconate, etc.; crotonic acid esters such as ethylene glycol dicrotonate, tetramethylene glycol dicrotonate, pentaerythritol dicrotonate, sorbitol tetracrotonate, etc.; isocrotonic acid esters such as ethylene glycol diisocrotonate, pentaerythritol diisocrotonate, sorbitol tetraisocrotonate, etc.; maleic acid esters such as ethylene glycol dimaleate, triethylene glycol dimaleate, pentaerythritol dimaleate, sorbitol tetramaleate, etc. Further, mixtures of the above-mentioned esters are also included.

Specific examples of amides of aliphatic polyvalent amine compounds and unsaturated carboxylic acids include methylenebis-acrylamide, methylenebismethacrylamide, 1,6-hexamethylenebis-acrylamide, 1,6-hexamethylenebis-methacrylamide, diethylenetriamine trisacrylamide, xylylenebisacrylamide, xylylenebismethacrylamide, etc.

Other examples include vinyl urethane compounds containing two or more polymerizable vinyl groups in one molecule, which are obtained by reacting vinyl monomers containing a hydroxy group, which are represented by the formula $$CH_2{=}CR{-}COO{-}CH_2{-}CHR'{-}OH$$

wherein R and R' each represents H or $CH_3$, with polyisocyanate compounds containing two or more isocyanate groups per one molecule, described in Japanese Patent Publication No. 41708/73, and the like.

Preferred vinyl monomers which are used in the present invention are monofunctional or polyfunctional methacrylates and polyvalent acrylates.

Further, the vinyl monomer is generally employed in an amount of from 0.2 to 20 parts by weight, and preferably from 1 to 10 parts by weight, per 1 part by weight of the diazo compound.

The vinyl monomer is incorporated into the core substance, together with the diazo compound; in this case, organic solvents used as solvents (or dispersing media) for the core substance can be partly or wholly replaced by the vinyl monomer.

The compounds used in the present invention which release free radicals upon exposure to light (hereafter referred to as "free radical releasing agents") are well known in the field of graphic arts.

These compounds are widely used as photopolymerization initiators, etc., in photopolymerizable compositions, and in light-sensitive materials prepared for various image forming systems.

Specific examples of particularly preferred free radical releasing agents which can be employed in the present invention include the following compounds: aromatic ketones (for example, benzophenone, 4,4'-bis(dimethylamino)benzophenone, 4,4'-bis(diethylamino)benzophenone, 4-methoxy-4'-(dimethylamino)benzophenone, 4,4'-dimethoxybenzophenone, 4-dimethylaminobenzophenone, 4-methoxy-3,3'-dimethylbenzophenone, 1-hydroxycyclohexyl phenyl ketone, 4-dimethylaminoacetophenone, 2-methyl-1-[4-(methylthio)phenyl]-2-morpholinopropanone-1-acetophenone, benzyl); aromatic cyclic ketones (for example, fluorenone, anthrone, xanthone, thioxanthone, 2-chlorothioxanthone, 2,4-dimethylthioxanthone, 2,4-diethylthioxanthone, acridone, N-ethylacridone, benzanthrone); quinones (for example, benzoquinone, 2,3,5-trimethyl-6-bromobenzoquinone, 2,6-di-n-decylbenzoquinone, 1,4-naphthoquinone, 2-isopropoxy-1,4-naphthoquinone, 1,2-naphthoquinone, anthraquinone, 2-chloroanthraquinone, 2-methylanthraquinone, 2-tert-butylanthraquinone, phenanthraquinone), benzoin, benzoin ethers (for example, benzoin methyl ether, benzoin ethyl ether, 2,2-dimethoxy-2-phenylacetophenone, α-methylolbenzoin methyl ether); aromatic polycyclic hydrocarbons (for example, naphthalene, anthracene, phenanthrene, pyrene); azo compounds (for example, azobisisobutyronitrile, α-azo-1-cyclohexanecarbonitrile, azobisvaleronitrile), organic disulfides (for example, thiuranium disulfide); acyloxime esters (for example, benzyl-(o-ethoxycarbonyl)-α-monoxime).

It is preferred that the addition amount of the free radical releasing agent is from 0.01 to 5 parts by weight, and more preferably from 0.1 to 1 part by weight, per 1 part by weight of the diazonium salt.

By enclosing the free radical releasing agent together with the diazonium salt as the core substances of the microcapsules, the aforesaid yellow coloration at the background which occurs after photofixation can be minimized.

The diazo compounds which are employed in the present invention are preferably diazonium salts represented by the formula $$ArN_2^+X^-$$

wherein Ar represents a substituted or unsubstituted aromatic moiety, $N_2^+$ represents a diazonium group, and $X^-$ represents an acid anion. These compounds are capable of forming color through a coupling reaction with the coupling component, and are also capable of being decomposed by light.

As the aromatic moiety, specifically preferred moieties are represented by the formula

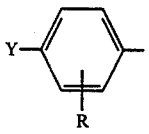

wherein Y represents a substituted amino group, an alkoxy group, an arylthio group, an alkylthio group or an acylamino group, and R represents an alkyl group, an alkoxy group, an arylamino group, or a halogen atom (e.g., I, Br, Cl, F).

As the substituted amino group for Y, a monoalkylamino group, a dialkylamino group, an arylamino group, a morpholino group, a piperidino group, and a pyrrolidino group are preferred.

Specific examples of the diazonium which form salts include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, 4-diazo-1-pyrrolidino-2-ethylbenzene, etc.

Specific examples of acid anions forming salts together with the diazo compounds include $C_nF_{2n+1}COO^-$, wherein n is an integer of 3 to 9, $C_mF_{2m+1}SO_3^-$, wherein m is an integer of 2 to 8, $(C_lF_{2l+1}SO_2)_2CH^-$, wherein l is an integer of 1 to 18,

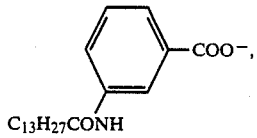

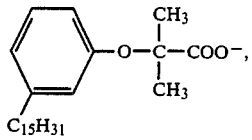

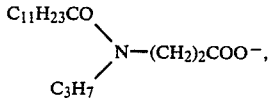

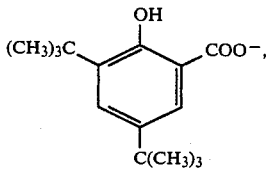

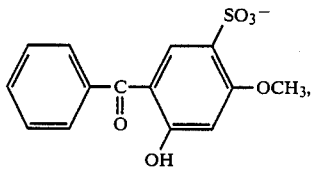

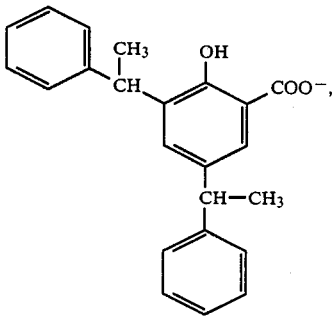

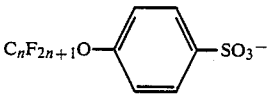

wherein n is an integer of 3 to 9,

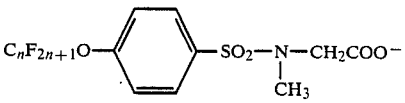

wherein n is an integer of 3 to 9, $BF_4^-$, $PF_6^-$, etc.

Acid anions containing a perfluoroalkyl group or a perfluoroalkenyl group or $PF_6^-$ are particularly preferred because increases in fogging are thereby minimized during storeage.

Specific examples of the diazo compounds (diazonium salts) include the following compounds.

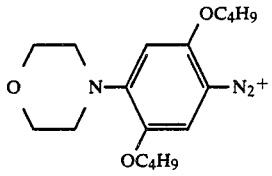

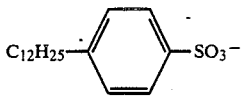

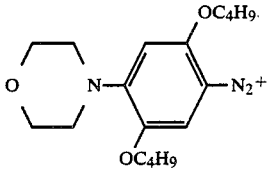

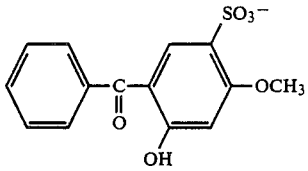

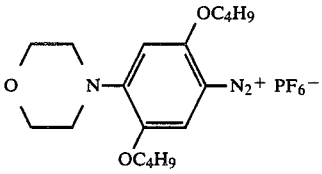

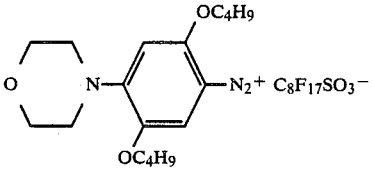

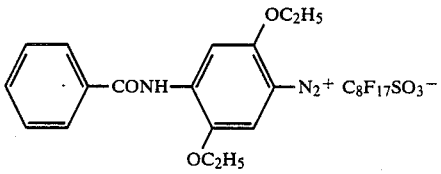

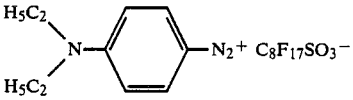

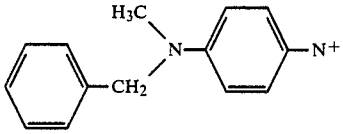

-continued

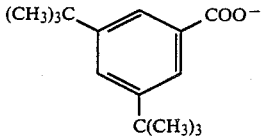

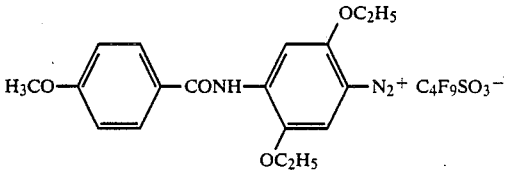

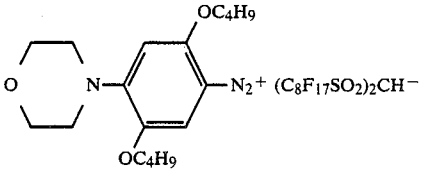

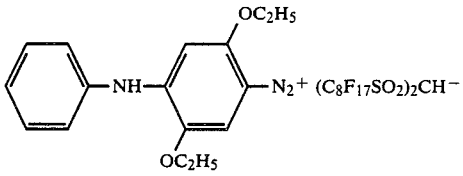

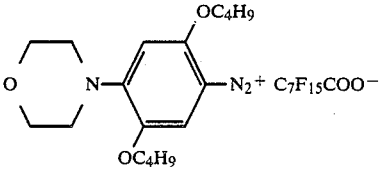

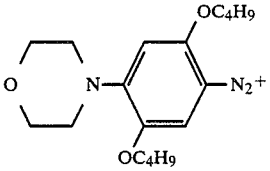

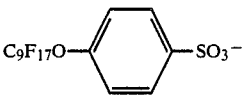

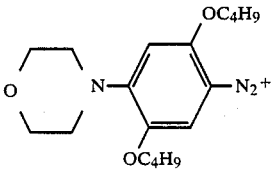

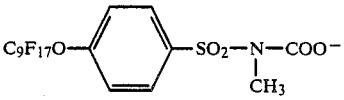

The coupling component to be used in the present invention is a compound which couples with the diazo compound (diazonium salt) to form a dye. Such coupling component includes a compound of the type that the coloration is accelerated depending upon the presence of a basic substance, and a compound of the type that the high coloration density is obtained regardless of the presence of a basic substance. The typical examples of the former type coupling components depending upon the basic substance include resorcin, phloroglucin, sodium 2,3-dihydroxynaphthalene-6-sulfonate, 1-hydroxy-2-naphthoic acid-morpholinopropylamide, 1,5-dihydroxynaphthalene, 2,3-dihydroxynaphthalene, 2,3-dihydroxy-6-sulfanylnaphthalene, 2-hydroxy-3-naphthoic acid-anilide, 2-hydroxy-3-naphthoic acid-2'-methylanilide, 2-hydroxy-3-naphthoic acid-ethanolamide, 2-hydroxy-3-naphthoic acid-octylamide, 2-hydroxy-3-naphthoic acid-N-dodecyloxypropylamide, 2-hydroxy-3-naphthoic acid-tetradecylamide, acetanilide, acetoacetanilide, benzoylacetanilide, 1-phenyl-3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamido-5-pyrazolone, etc. The typical examples of the latter type coupling components regardless of the presence of a basic substance include an active methylene compounds, for example, β-keto-carboxylic acid amides such as benzoylacetanilide, pivaloylacetanilide, 1,3-bis(-benzoylacetamino)toluene, 1,3-bis(-pivaloylacetaminomethyl)benzene, etc., pyrazolones such as 3-methyl-1-phenylpyrazolone, 3-hexylcarbamoyl-1-phenylpyrazolone, 3-myristoylamino-1-(2,4,6-trichlorophenyl)pyrazolone, etc., barbituric acids such as 1,3-didodecylbarbituric acid, 1,3-dicyclohexylbarbituric acid, 1-octyl-3-stearylbarbituric acid, etc., 1,3-cyclohexanediones such as 5,5-dimethyl-1,3-cyclohexanedione, 5,5-dimethyl-4-phenyl-1,3-cyclohexanedione, etc.; an aromatic amine type compound, for example, α-naphthylamine, β-naphthylamine, 1-anilinonaphthalene, 2-anilinonaphthalene, 3-aminodiphenylamine, 4,4'-diaminodiphenylmethane, N,N-dicyclohexylaniline, 2-aminocarbazole, 2-phenylindole, 1-phenyl-2-methylindole, and an organic or inorganic acid salt of an aromatic amine such as a p-toluenesulfonic acid salt of N,N-dimethylaniline and α-naphthylamine hydrochloride, etc.; and an aromatic hydroxy compounds having a basic group in the molecular structure thereof, for example, 2-hydroxy-3-naphthoic acid-3'-morpholinopropylamide, 2-hydroxy-3-naphthoic acid-2'-diethylaminoethylamide, 2-hydroxy-3-naphthoic acid-3-piperidinopropylamide, 2-hydroxy-3-naphthoic acid-3'-piperidinopropylamide, 2-hydroxy-3-naphthoic acid-p-(3'-N'-cyanoguanidinopropyl)oxyanilide, salicylic acid-p-(3'-morpholinopropyl)oxyanilide, 1-naphthol-4-sulfonic acid-3'-diethylaminopropylamide, 8-hydroxyquinoline-4-sulfonic acid-2'-diethylaminoethylamide, and an aromatic hydroxy compound having a residue such as an organic carboxylic acid salt of amines capable of forming basic when heated, e.g., a trichloroacetic acid salt of 2-hydroxy-3-naphthoic acid-3'-morpholinopropylamide, a phenylthioacetic acid salt of 1-naphthol-4-sulfonic acid-3'-diethylaminopropylamide, etc. An image of an optional color may be obtained by using two or more of these coupling components in combination.

As the basic substance of the present invention, basic substances which are sparingly soluble or insoluble in water or substances which release alkalis upon heating can be used.

As basic substances, mention may be made of nitrogen-containing compounds such as inorganic and organic ammonium salts; organic amines; amides; urea, thiourea and derivatives thereof; thiazoles, pyrroles, pyrimidines; piperazines; guanidines; indoles; imidazoles; imidazolines; triazoles; morpholines; piperizines; amidines; formamidines; pyridines; etc. Specific examples include ammonium acetate, tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-ditolylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazinobenzothiazole, etc. These basic substances may also be used in combination of two or more.

In the present invention, the diazo compound and the vinyl monomer to be contained in the core substance of the microcapsules are dissolved or dispersed in a water-insoluble organic solvent, around of which microcapsule walls are, after emulsification, formed through polymerization. As the organic solvents, solvents having a boiling point higher than 180° C. are preferred. Specifically there are used phosphoric acid esters, phthalic acid esters, other carboxylic acid esters, aliphatic acid amides, alkylated biphenyl, alkylated terphenyl, chlorinated paraffin, alkylated naphthalene, diaryl ethanes, etc. Specific examples of these compounds include tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, isopropyl biphenyl, isoamyl biphenyl, chlorinated paraffin, diisopropylnaphthalene, 1,1'-ditolylethane, 2,4-di-tertiary-aminophenol, N,N-dibutyl-2-butoxy-5-tertiary-octylaniline, etc.

Of these solvents, particularly preferred are ester type solvents such as dibutyl phthalate, tricresyl phosphate, diethyl phthalate, dibutyl maleate, etc. The preferred amount of the organic solvent contained in the liquid droplets emulsified as a core substance is 10 to 70 wt %, more preferably 20 to 55 wt %.

The microcapsules of the present invention are prepared by emulsifying the core substance containing the diazo compound and the vinyl monomer therein and then forming walls of polymeric substances around the oil droplets. Reactants for forming the polymeric substances can be provided inside the oil droplets and/or outside the oil droplets. Specific examples of useful polymeric substance include polyurethane, polyurea, polyamide, polyester, polycarbonate, urea-formaldehyde resin, melamine resin, polystyrene, styrene-methacrylate copolymers, styrene-acrylate copolymers, gelatin, polyvinylpyrrolidone, polyvinyl alcohol, etc.

The polymeric substances may be used in combinations of two or more. Preferred polymeric substances are polyurethane, polyurea, polyamide, polyester and polycarbonate; polyurethane and polyurea are more preferred.

For preparing walls of the microcapsules according to the present invention, the effects are remarkable in the case of using the microencapsulation method with polymerization of reactants supplied to the inside of the oil droplets. Namely, preferred capsules having a uniform particle diameter can be obtained in a short period of time as recording materials having excellent shelf storage.

This technique and specific examples of compounds are described, for example, in U.S. Pat. Nos. 3,726,804 and 3,796,669.

In the case of using, for example, polyurethane, as the capsule wall material, the microcapsule walls can be formed by: incorporating into an oily liquid to be encapsulated polyvalent isocyanates and a second material (for example, polyol) which reacts with the polyvalent isocyanates to form capsule walls; emulsifying and dispersing the resulting mixture in water; and then elevating temperature to cause a reaction for forming polymeric substances at the interface of the oil droplets. In this case, auxiliary solvents having a low boiling point and having a strong solubility can be used in combination with the oil liquid.

Polyisocyanates and polyols or polyamines which react with polyisocyanates are disclosed in U.S. Pat. Nos. 3,281,383, 3,773,695 and 3,793,268, Japanese Patent Publication Nos. 40347/73 and 24159/74 (corresponding to British Pat. No. 1,127,338 and U.S. Pat. No. 3,723,363, respectively), and Japanese Patent Application (OPI) Nos. 80191/73 and 84086/73 (corresponding to U.S. Pat. No. 3,838,108 and British Pat. No. 1,416,224, respectively), which may also be used.

The process of preparing a capsule wall of the present invention is not limited to the above-described processes. All polymeric substances formed by the reaction of polyvalent isocyanate and polyol are preferably used as a capsule wall of the present invention. The thermal permeability of the reactive substances may be varied appropriately by the combination of these substances.

Specific examples of polyvalent isocyanate include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-biphenyl diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate, etc.; triisocyanates such as 4,4',4''-triphenylmethane triisocyanate, toluene2,4,6-triisocyanate, etc.; tetraisocyanates such as 4,4'-dimethyldiphenylmethane-2,2',5,5'-tetraisocyanate; isocyanate prepolymers such as addition products of hexamethylene diisocyanate and trimethylolpropane, addition products of 2,4-tolylene diisocyanate and trimethylolpropane, addition products of xylylene diisocyanate and trimethylolpropane, addition products of tolylene diisocyanate and hexanetriol, etc.

Specific examples of polyols include aliphatic and aromatic polyvalent alcohols, hydroxypolyesters, hydroxypolyalkylene ethers, etc. Preferred polyols are polyhydroxy compounds containing the structural formula (I), (II), (III), or (IV) between two hydroxy groups in the molecular structure thereof, and having a molecular weight of 5,000 or less.

(I) aliphatic hydrocarbon group having from 2 to 8 carbon atoms

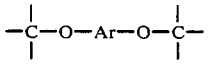

(II)

-continued

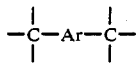

(III)

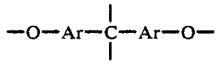

(IV)

Ar in structural formulae (II), (III), and (IV) represents a substituted or unsubstituted aromatic moiety and the aliphatic hydrocarbon group for (I) contains a moiety of the formula $-C_nH_{2n}-$ as its basic skeleton in which a hydrogen group may optionally be substituted with other elements.

Specific examples of polyols comprising (I) include ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, phenylethylene glycol, 1,1,1-trimethylolpropane, hexanetriol, pentaerythritol, glycerin, etc.

Specific examples of polyols comprising (II) include condensation products of aromatic polyvalent alcohols such as 1,4-di(2-hydroxyethoxy)benzene, resorcinol dihydroxyethyl ether, etc., and alkylene oxides, etc.

Specific examples of polyols comprising (III) include p-xylylene glycol, m-xylylene glycol, $\alpha,\alpha'$-dihydroxy-p-diisopropylbenzene, etc.

Specific examples of polyols comprising (IV) include 4,4'-dihydroxydiphenylmethane, 2-(p,p'-dihydroxydiphenylmethyl)benzyl alcohol, addition products of bisphenol A and ethylene oxide, addition products of bisphenol A and propylene oxide, etc.

It is desirable to use polyols in such an amount that 0.02 to 2 mols of hydroxy group per 1 mol of isocyanate group may be present in starting the reaction.

Specific examples of the polyamine, which can be used instead of the polyol, include ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine, an amine adduct of epoxy resin, etc.

Further, the polyvalent isocyanate is able to form a polymeric substance as a preferred capsule wall by the reaction with water.

If other conditions are maintained unchanged, the wall thickness can be varied by changing an additive amount of polyisocyanate, polyol, or polyamine. If other conditions are maintained unchanged, the particle size, and therefore the wall thickness, can be varied by changing the state of agitation in emulsifying/dispersing.

In the preparation of the microcapsules, watersoluble polymeric substances can be used. The watersoluble polymeric substances may be any one of anionic polymers, nonionic polymers, and amphoteric polymers.

The anionic polymer may be natural or synthetic; for example, those containing a $-COO^-$, $-SO_3^-$ group, etc., may be used. Specific examples of natural anionic polymers include gum arabic, alginic acid, etc.; specific examples of semisynthetic anionic polymers include carboxymethyl cellulose, phthalated gelatin, sulfated starch, sulfated cellulose, lignin sulfonate, etc. As the synthetic anionic polymers, there are maleic anhydride type (including hydrolysis products) copolymers, acrylic acid type (including methacrylic acid type) polymers and copolymers, vinylbenzenesulfonic acid type polymers and copolymers, carboxy-modified polyvinyl alcohols, and the like.

Nonionic polymers include polyvinyl alcohols, hydroxyethyl cellulose, methyl cellulose, etc.

Amphoteric polymers include gelatin and the like.

These water-soluble polymeric substances are used as 0.01 to 10 wt % aqueous solutions. The particle diameter (average diameter) of the microcapsules is adjusted to 20 μm or less. When the particle diameter exceeds 20 μm, the quality of printed images generally tends to be inferior.

Particularly in the case that heating is conducted from the coated layer side using a thermal head, it is preferred that the particle diameter is controlled to 8 μm or less in order to minimize fogging upon pressure.

Of the main components of the present invention (i.e., the diazo compound, the coupling component, and the basic compound), the diazo compound is used as the core substance of the microcapsules; the other two components may be incorporated in the core substance of the microcapsules or may be present outside of the microcapsules.

In the case that the diazo compound and the other one component are incorporated into microcapsules, the microcapsules may be the same or different ones. In the case that the other two components are incorporated in microcapsules, various combinations are provided while the three components cannot be incorporated into the same microcapsules. The component(s) other than those not contained in the core substances of the microcapsules are used in a heat-sensitive layer outside of the microcapsules.

When the microcapsules are prepared, they may be prepared from an emulsion containing 0.2 wt % or more of the diazo compound.

It is preferred that the coupling component and the basic substance used in the present invention be used in a ratio of from 0.1 to 10 parts by weight (preferably 0.3 to 4 parts by weight) of the coupling component, and in a ratio of from 0 to 20 parts by weight (preferably 0.1 to 4 parts by weight) of the basic substance, per 1 part by weight of the diazo compound, both in the case of incorporating them in the interior of the microcapsules or in the outside heat-sensitive layer of the microcapsules. Further, it is preferred that the diazo compound be coated in an amount of from 0.05 to 5.0 g/m$^2$.

The coupling component and the basic substance used in the present invention are preferably employed by solid-dispersing them together with the water-soluble polymeric substances by means of a sand mill, etc., when they are not microencapsulated. Preferred examples of such water-soluble polymeric substances are the watersoluble polymeric substances used for preparing microcapsules. In this case, the water-soluble polymeric substances have a concentration of 2 to 30 wt %, preferably 2 to 5 wt % and the coupling component and the basic substance are incorporated so as to be 5 to 40 wt %, respectively, based on the total weight of the water-soluble polymeric substance solutions, preferably 20 to 40 wt %.

It is preferred that the dispersed particle size be 10 μm or less.

For purposes of preventing sticking to a thermal head or improving writability, the heat-sensitive recording material of the present invention may contain pigments such as silica, barium sulfate, titanium oxide, aluminum hydroxide, zinc oxide, calcium carbonate, etc., fine powders such as styrene beads, urea-melamine resin, etc.

Likewise, metal soaps may also be used for preventing sticking. These are used in an amount of 0.2 to 7 g/m$^2$, preferably 0.2 to 2 g/m$^2$.

Further, the heat-sensitive recording material of the present invention may contain heat fusible substances to increase the density for thermal recording. The heat fusible substances are substances which are solid at normal room temperature (about 20° C.) but melt upon heating with a thermal head, having a melting point of 50° to 150° C., which dissolve the diazo compound, the coupling component or the basic substance. The heat fusible substances are dispersed into particles of 0.1 to 10 μm and used as a solid content of 0.2 to 7 g/m$^2$. Specific examples of these heat fusible substances are fatty acid amides, N-substituted fatty acid amides, ketone compounds, urea compounds, esters, etc.

Suitable binders may be coated on the heat-sensitive recording material of the present invention.

Examples of such binders that can be used include various emulsions of polyvinyl alcohol, methyl cellulose, carboxymethyl cellulose, hydroxypropyl cellulose, gum arabic, gelatin, polyvinylpyrrolidone, casein, styrene-butadiene latex, acrylonitrile-butadiene latex, polyvinyl acetate, polyacrylic acid esters, ethylene-vinyl acetate copolymer, etc. The amount to be used is generally from 0.5 to 5 g/m$^2$ (solids content), preferably 0.5 to 3 g/m$^2$.

In addition to the foregoing materials, citric acid, tartaric acid, oxalic acid, boric acid phosphoric acid or pyrophosphoric acid may be added as acid stabilizers in the present invention.

The heat-sensitive recording material of the present invention is obtained by preparing a coating solution containing the main components consisting of the diazo compound, the coupling component and the basic substance and other additives, coating the coating solution onto a support such as paper, synthetic resin film, etc., by means of coating methods such as bar coating, blade coating, air knife coating, gravure coating, roll coating, spray coating, dip coating, etc., and then drying to provide a heat-sensitive layer having a solid content of from 2.5 to 25 g/m$^2$ (preferably 4 to 15 g/m$^2$) on the support. Another method comprises preparing a coating solution by adding the coupling component and the basic component as the main components and other additives as the core substances of the microcapsules, solid-dispersing the main components or dissolving them as an aqueous solution, coating the coating solution onto a support and drying to provide a precoating layer having a solid content of from 2 to 10 g/m$^2$ (preferably 5 to 10 g/m$^2$) on the support, and coating further thereon a coating solution of the diazo compound as the main component and other additives formed into the core substances of the microcapsules and then drying to a coating layer having a solid content of from 1 to 15 g/m$^2$ (preferably 4 to 15 g/m$^2$), and finally laminating the coating layers to form a laminate type heat-sensitive recording material. The laminate type heat-sensitive recording material may also be composed of the foregoing layers in a reversed order. The coating method may be sequential or simultaneous coating of the laminate layers. The laminate type heat-sensitive recording material provides excellent characteristics, particularly for shelf storage over a long period of time.

When neutral paper having a pH of from 6 to 9 obtained by sizing with neutral sizing agents such as alkyl ketene dimers, etc., and thermal extraction (as described in Japanese Patent Application (OPI) No. 14281/80, corresponding to U.S. Pat. No. 4,255,491) is used as the paper for the support, shelf storage is good with the passage of time.

In order to prevent the coating solution from permeating through the paper support, and for bringing the heat-sensitive recording layer into good contact with a thermal recording head, papers described in Japanese Patent Application (OPI) No. 116687/82 (corresponding to U.S. Pat. No. 4,416,939) which satisfy the following condition:

$$\frac{\text{Stokigt sizing degree}}{(\text{meter basis weight})^2} \geqq 3 \times 10^{-3}$$

and which have Bekk smoothness of 90 seconds or more are advantageous.

Advantageously used in the present invention are papers such as those having optical surface roughness of 8 μm or less and a thickness of 40 to 75 μm as described in Japanese Patent Application (OPI) No. 136492/83; paper having a density of 0.9 g/cm$^3$ and optical contact rate of 15% or more as described in Japanese Patent Application (OPI) No. 69091/83 (corresponding to U.S. patent application Ser. No. 436,083); paper obtained by paper-making of pulp subjected to beating treatment to 400 cc or more in a Canadian standard freeness (JIS P8121) to prevent a coating solution from permeation, as described in Japanese Patent Application (OPI) No. 69097/83 (corresponding to U.S. patent application Ser. No. 435,803); paper having as a coated surface a gloss surface of base paper prepared by paper-making with a Yankee machine to improve color density and resolving power, as described in Japanese Patent Application (OPI) No. 65695/83 (corresponding to U.S. Pat. No. 4,466,007); paper having improved coatability by subjecting base paper to a corona discharge treatment, as described in Japanese Patent Application (OPI) No. 35985/84; etc. Use of such papers provides good results. In addition to these paper supports, any supports used in the conventional heat-sensitive recording paper field may be used as the supports of the present invention.

The heat-sensitive recording material of the present invention may be used as a printing paper for facsimile and electronic computers, which require high speed recording. In addition, the heat-sensitive recording material of the present invention can be fixed, after thermal printing, by decomposing the unreacted diazo compound upon exposure to light. Furthermore, the heat-sensitive recording material of the present invention may also be used as thermally developable copying paper.

Hereafter, examples are shown below, but the present invention is not deemed to be limited thereto. In the examples, the term "part" indicating addition amount is used to mean "part by weight".

EXAMPLE 1

In a solvent mixture of 6 parts of tricresyl phosphate, 18 parts of trimethylolpropane trimethacrylate and 6 parts of dichloromethane, were dissolved 4 parts of the following diazo compound.

The diazo compound used is represented by the formula:

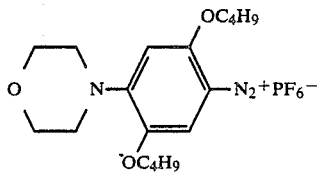

together with 18 parts of an addition product of xylylene diisocyanate and trimethylolpropane (3/1 in molar ratio). The resulting diazo compound solution was added to an aqueous solution of 5.2 parts of polyvinyl alcohol in 58 parts of water and the mixture was emulsified and dispersed at 20° C. to obtain an emulsion having an average particle size of 2.5 μm. To the thus obtained emulsion, 100 parts of water were added. The temperature was elevated to 60° C. while stirring. A capsule solution containing the diazo compound as the core substance was obtained 2 hours later.

Next, 10 parts of 2-hydroxy-3-naphthoic acid anilide and 10 parts of triphenyl guanidine were added to 100 parts of a 5% polyvinyl alcohol aqueous solution. The mixture was dispersed for about 24 hours using a sand mill to obtain a dispersion of the coupling component having an average particle size of 3 μm and triphenyl guanidine.

To 50 parts of the thus obtained capsule solution of the diazo compound, 24 parts of the dispersion of the coupling component and triphenyl guanidine were added to make a coating solution. The coating solution was coated onto smooth wood free paper (50 g/m$^2$) in a dry weight of 6 g/m$^2$ using a coating rod, which was dried at 40° C. for 30 minutes to obtain a heat-sensitive recording material.

The obtained heat-sensitive recording material was thermally recorded using GIII mode (Hifax 700, manufactured by Hitachi Co., Ltd.), and was then wholly exposed to light using Ricopy Super Dry 100 (manufactured by Ricoh Co., Ltd.) followed by fixing. The blue density of the thus obtained recorded images was measured using a Macbeth reflection densitometer. Likewise, the yellow density at the background was measured. The results are shown in Table 1. On the other hand, thermal recording was made again on the fixed areas but no image was recorded and it was confirmed that the images were fixed.

Next, to examine shelf storage, the background density (fog) of the heat-sensitive recording material and fog after forced deterioration test by storing the heat-sensitive recording material in the dark for 24 hours under conditions of 40° C. and relative humidity (RH) of 90% were measured using a Macbeth reflection densitometer to determine change in fog. The results are shown in Table 1.

EXAMPLES 2 TO 6

Heat-sensitive recording materials 2 through 6 were prepared in a manner similar to Example 1 except that vinyl monomers shown in the following table were used in place of trimethylolpropane trimethacrylate of Example 1. The heat-sensitive recording materials were examined in the same manner as Example 1. The results are shown in Table 1.

| Example | Vinyl Monomer |
|---|---|
| 2 | Trimethylolpropane triacrylate |
| 3 | Benzyl methacrylate |
| 4 | Dipentaerythritol hexaacrylate |
| 5 | Pentaerythritol tetramethacrylate |
| 6 | Pentaerythritol tetraacrylate |

EXAMPLE 7

Heat-sensitive recording materials were obtained in a manner similar to Example 1, except that 16 parts of a dispersion of p-benzyloxyphenol shown below were further added to the capsule solution and the resulting coating solution was coated in a dry weight of 8 g/m$^2$. The obtained recording materials were examined in the same manner as Example 1. The results are shown in Table 1. Dispersion of p-Benzyloxyphenol:

To 100 parts of a 5% polyvinyl alcohol aqueous solution were added 20 parts of p-benzyloxyphenol. The mixture was dispersed for about 24 hours using a sand mill to prepare a dispersion having an average particle diameter of 3 μm.

COMPARATIVE EXAMPLE 1

A heat-sensitive recording material was obtained in a manner similar to Example 1 except that trimethylolpropane trimethacrylate was omitted, and instead, 24 parts of tricresyl phosphate were used in Example 1. The test results are shown in Table 1.

COMPARATIVE EXAMPLE 2

A heat-sensitive recording material was obtained in a manner similar to Example 1 except that trimethylolpropane trimethacrylate and tricresyl phosphate were omitted and instead, 24 parts of dibutyl phthalate were used in Example 1. The test results are shown in Table 1.

TABLE 1

| Heat-Sensitive Recording Material | Test Results | | | |
|---|---|---|---|---|
| | Image Density | Yellow Density in the Background | Blue Density in the Background | Blue Density in the Background after Deterioration Test |
| Example 1 | 1.21 | 0.17 | 0.09 | 0.13 |
| Example 2 | 1.15 | 0.17 | 0.10 | 0.14 |
| Example 3 | 1.20 | 0.18 | 0.10 | 0.14 |
| Example 4 | 1.13 | 0.18 | 0.09 | 0.13 |
| Example 5 | 1.13 | 0.18 | 0.08 | 0.12 |
| Example 6 | 1.16 | 0.17 | 0.08 | 0.13 |
| Example 7 | 1.29 | 0.15 | 0.10 | 0.13 |
| Comparative Example 1 | 1.20 | 0.30 | 0.09 | 0.13 |
| Comparative Example 2 | 1.21 | 0.39 | 0.08 | 0.13 |

As is evident from Table 1, the yellow density in the background was quite high in Comparative Examples 1 and 2; however, in Examples 1 to 7 of the present invention, the yellow density was low, providing improved results.

EXAMPLE 8

In a solvent mixture of 24 parts of tricresyl phosphate, 0.5 part of 2,2-dimethoxy-2-phenylacetophenone and 6 parts of dichloromethane were dissolved 4 parts of the following diazo compound

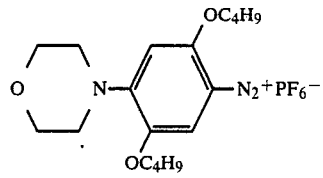

together with 18 parts of an addition product of xylylene diisocyanate and trimethylolpropane (3/1 in molar ratio). The resulting diazo compound solution was added to an aqueous solution of 5.2 parts of polyvinyl alcohol in 58 parts of water and the mixture was emulsified and dispersed at 20° C. to obtain an emulsion having an average particle size of 2.5 μm. To the thus obtained emulsion, 100 parts of water were added. The temperature was elevated to 60° C. while stirring. A capsule solution containing the diazo compound as the core substance was obtained 2 hours later.

Next, 10 parts of 2-hydroxy-3-naphthoic acid anilide and 10 parts of triphenyl guanidine were added to 100 parts of a 5% polyvinyl alcohol aqueous solution. The mixture was dispersed for about 24 hours using a sand mill to obtain a dispersion of the coupling component having an average particle size of 3 μm and triphenyl guanidine.

To 50 parts of the thus obtained capsule solution of the diazo compound, 24 parts of the dispersion of the coupling component and triphenyl guanidine were added to make a coating solution. The coating solution was coated onto smooth wood free paper (50 g/m$^2$) in a dry weight of 6 g/m$^2$ using a coating rod, which was dried at 40° C. for 30 minutes to obtain a heat-sensitive recording material. Test Method:

The obtained heat-sensitive recording material was thermally recorded using GIII mode (Hifax 700, manufactured by Hitachi Co., Ltd.), and was then wholly exposed to light using a high pressure mercury arc lamp (Jet Light, manufactured by Orc Co., Ltd.) followed by fixing. The blue density of the thus obtained recorded images was measured using a Macbeth reflection densitometer. Likewise, the yellow density at the background was measured. The results are shown in Table 2. On the other hand, thermal recording was made again on the fixed areas but no image was recorded and it was confirmed that the images were fixed.

Next, to examine shelf storage, the background density (fog) of the heat-sensitive recording material and fog after the forced deterioration test were also measured as in Example 1. The results are shown in Table 2.

EXAMPLES 9 TO 14

Heat-sensitive recording materials 9 through 14 were prepared in a manner similar to Example 8, except that free radical releasing agents shown in the following table were used in place of 2,2-dimethoxy-2-phenylacetophenone of Example 8.

The obtained heat-sensitive recording materials were examined in the same manner as Example 8. The results are shown in Table 2.

| Example | Free Radical Releasing Agent |
|---|---|
| 9 | Benzophenone |
| 10 | 2-Isopropoxy-1,4-naphthoquinone |
| 11 | t-Butylanthraquinone |
| 12 | Azobisisobutyronitrile |
| 13 | 2,3,5-Trimethyl-6-bromoquinone |
| 14 | 2,6-Didecylquinone |

COMPARATIVE EXAMPLE 3

A heat-sensitive recording material was obtained in a manner similar to Example 8 except that 2,2-dimethoxy-2-phenylacetophenone was omitted in Example 8.

The obtained recording material was examined in manner similar to Example 8. The rest results are shown in Table 2.

COMPARATIVE EXAMPLE 4

A heat-sensitive recording material was obtained in a manner similar to Example 8 except that tricresyl phosphate was omitted and instead, 24 parts of dibutyl phthalate were used in Comparative Example 1. The obtained recording material was examined in manner similar to Example 8. The test results are shown in Table 2.

TABLE 2

| Heat-Sensitive Recording Material | Test Results: Image Density | Yellow Density in the Background | Blue Density in the Background | Blue Density in the Background after Deterioration Test |
|---|---|---|---|---|
| Example 8 | 1.21 | 0.15 | 0.09 | 0.13 |
| Example 9 | 1.20 | 0.15 | 0.09 | 0.14 |
| Example 10 | 1.21 | 0.19 | 0.10 | 0.13 |
| Example 11 | 1.19 | 0.20 | 0.10 | 0.14 |
| Example 12 | 1.21 | 0.20 | 0.11 | 0.15 |
| Example 13 | 1.14 | 0.21 | 0.11 | 0.14 |
| Example 14 | 1.14 | 0.19 | 0.10 | 0.15 |
| Comparative Example 3 | 1.21 | 0.30 | 0.09 | 0.13 |
| Comparative Example 4 | 1.20 | 0.39 | 0.09 | 0.13 |

As is evident from Table 1, the yellow density in the background was quite high in Comparative Examples 3 and 4; however, in Examples 8 to 14 of the present invention, the yellow density was low and no deterioration was noted in other efficiencies.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a recording layer containing a diazo compound and a coupling component, wherein the improvement comprises providing microcapsules in said recording layer containing said diazo compound and further containing one, but not both, of a polymerizable compound containing an ethylenically unsaturated bond or a compound capable of releasing a free radical upon exposure to light.

2. A heat-sensitive recording material as in claim 1, wherein said polymerizable compound containing an ethylenically unsaturated bond is a vinyl monomer.

3. A heat-sensitive recording material as in claim 1, wherein said polymerizable compound containing an ethylenically unsaturated bond is selected from the group consisting of unsaturated carboxylic acids and salts thereof, esters of unsaturated carboxylic acids with aliphatic polyvalent alcohol compounds, and amides of unsaturated carboxylic acids with aliphatic polyvalent amine compounds.

4. A heat-sensitive recording material as in claim 1, wherein said polymerizable compound containing an ethylenically unsaturated bond is a vinyl urethane compound containing two or more polymerizable vinyl groups in one molecule, which are obtained by reacting vinyl monomers containing a hydroxy group, which are represented by the formula $$CH_2{=}CR{-}COO{-}CH_2{-}CHR'{-}OH$$

wherein R and R' each represents H or $CH_3$, with polyisocyanate compounds containing two or more isocyanate groups per one molecule.

5. A heat-sensitive recording material as in claim 1, wherein said polymerizable compound containing an ethylenically unsaturated bond is present in an amount of from 0.2 to 20 parts by weight per 1 part by weight of the diazo compound.

6. A heat-sensitive recording material as in claim 5, wherein said polymerizable compound containing an ethylenically unsaturated bond is present in an amount of from 1 to 10 parts by weight per 1 part by weight of the diazo compound.

7. A heat-sensitive recording material as in claim 1, wherein the compound capable of releasing a free radical upon exposure to light is present in an amount of from 0.01 to 5 parts by weight per 1 part by weight of the diazonium salt.

8. A heat-sensitive recording material as in claim 1, wherein said recording layer contains a basic substance or a substance capable of becoming basic when heated.

9. A heat-sensitive recording material as in claim 1, wherein the capsule wall formed in the microencapsulation is a polymeric substance selected from polyurethane, polyurea, polyamide, polyester, and polycarbonate.

10. A heat-sensitive recording material as in claim 1, wherein said microcapsules further contain an organic solvent.

* * * * *